United States Patent [19]

Wolf et al.

[11] 4,404,791

[45] Sep. 20, 1983

[54] SPINNING MACHINE

[75] Inventors: Horst Wolf, Albershausen; Hermann Guttler, Uhingen, both of Fed. Rep. of Germany

[73] Assignee: Zinser Textilmaschinen GmbH, Ebersbach, Fed. Rep. of Germany

[21] Appl. No.: 285,722

[22] Filed: Jul. 22, 1981

[30] Foreign Application Priority Data

Jul. 26, 1980 [DE] Fed. Rep. of Germany ..... 3028453

[51] Int. Cl.[3] ..... D01H 13/16

[52] U.S. Cl. ..... 57/80; 57/81; 57/86; 57/264

[58] Field of Search ..... 57/78, 80, 81, 86, 87, 57/264

[56] References Cited

U.S. PATENT DOCUMENTS

| | | | |
|---|---|---|---|
| Re. 30,776 | 10/1981 | Plate et al. | 57/264 X |
| 1,638,237 | 8/1927 | Borovoy et al. | 57/87 |
| 2,734,335 | 2/1956 | Saunders et al. | 57/86 |
| 4,150,533 | 4/1979 | Gasser et al. | 57/304 X |
| 4,176,514 | 12/1979 | Stalder | 57/261 |
| 4,280,321 | 7/1981 | Marzoli | 57/87 X |
| 4,300,342 | 11/1981 | Highsmith | 57/81 |

*Primary Examiner*—Donald Watkins

*Attorney, Agent, or Firm*—Sughrue, Mion, Zinn, Macpeak & Seas

[57] ABSTRACT

A ring spinning machine for spinning yarns comprised of finite length fibers has a plurality of spinning locations for combining two untwisted textile strands into a yarn to which a twist is imparted prior to winding up of the yarn. A sensor is associated at each spinning location which reacts to a break of one of the two fiber strands and causes an interruption of the spinning of the yarn. The sensor is designed to sense a characteristic of the yarn which changes in a manner recognizable by the sensor when the yarn is only being spun from one of the two fiber strands and an interrupter is provided which acts in response to the signal from the sensor to interrupt the spinning of the yarn upon the detection of a strand break.

9 Claims, 2 Drawing Figures

17
17'
16
14
15
33
34
22
22'
11
19
21
24
36
23
25
26
27
30
31
29
32
10

17,17'
40
41
24'
14
46
11
45
22,22'
19
42
43
44
10'

SPINNING MACHINE

BACKGROUND OF THE INVENTION

The present invention relates to a spinning machine and more specifically to a ring-type spinning machine for spinning yarns comprised of finite length fibers, preferably carded wool. The machine is provided with a plurality of spinning locations at each of which two textile fiber strands are run together at a joining point after leaving a drawing machine at spaced locations as untwisted fiber strands and are twisted together to form a yarn upon travel to a spindle or the like. A sensor is associated with each spinning location which reacts to a break of one of the two fiber strands by interrupting the spinning of the yarn.

The twisting of the yarn can be produced by conventional means, preferably by means of a spindle which is located coaxially within a spinning ring upon which a runner carried by the yarn travels during winding of the yarn on the spindle. It is also possible to provide other devices for producing the twist and for winding up the yarn such as a rotating spinning head, a wing spindle or the like.

The interruption of the spinning of the yarn after one of the two fiber strands breaks is desirable because the yarn spun after the break in one of the fiber strands, has only half the mass per unit length. In further processing of the yarn, this weak point may easily lead to yarn breaks and low quality goods. Each working location of the spinning machine where yarn is produced is designated hereinafter as a spinning location.

In prior art spinning machines of this type, such as that disclosed in German Utility Model 79 12 423 a sensor is associated with each spinning location and is provided with a yarn guide which is movably supported between two positions on a holder and which is held in balance in the first position and can be moved out of this balanced position to a new position limited by the influence of the yarn passing therethrough. However, when these movement limits are exceeded upon breaking of one of the two fiber strands, a break is produced in the remaining strand travelling to the spindle by the yarn guide pivoting downwardly in a vertical plane by about 180° or horizontally by about 90°. This causes the remaining strand to be diverted by the yarn guide through a sharp acute angle which sooner or later results in the breakage of this remaining strand. There is no guarantee, however, that this break will actually occur because the twisting imparted to this remaining strand by the spindle may extend through the yarn guide clear back to the drawing machine. In addition, even if the remaining strand does indeed break, the period of time before the break occurs can vary greatly and cannot be predicted ahead of time.

SUMMARY OF THE INVENTION

It is, therefore, an object of the present invention to create a new and improved spinning machine of the type described above in which the spinning of the yarn at each spinning location will be reliably interrupted as a result of a break in either of the two fiber strands.

It is a further object of the present invention to provide a new and improved spinning machine which is simple in construction, reliable in operation and cost effective.

The present invention provides a new and improved ring spinning machine for spinning yarns comprised of finite length fibers having a plurality of spinning locations at which two untwisted textile fiber strands are joined together after leaving a drawing machine and form a yarn which is twisted upon travel to a spindle and having a sensor associated at each spinning location which reacts to a break of one of the two fiber strands by interrupting the spinning of the yarn, wherein the sensor senses a characteristic of the yarn which changes in a manner recognizable to the sensor when the yarn is comprised of only one of the two fiber strands so that in consequence of each such change of the yarn characteristic detected by the sensor, the sensor activates an interrupter to interrupt the spinning of the yarn.

The present invention provides a new and improved ring spinning machine for spinning yarns comprised of finite length fibers having a plurality of spinning locations at which two untwisted textile fiber strands are run together at a joining point after leaving a drawing machine at spaced locations and twisted together to form a yarn upon travel to a spindle and having a sensor associated with each spinning location which reacts to a break of one of the two fiber strands by interrupting the spinning of the yarn, wherein a suction device is provided for aspirating fibers discharged from the drawing machine which are not incorporated into the yarn and said sensor reacts to the fibers drawn in by the suction device from the spinning location and causes the spinning of the yarn to be interrupted when the fiber discharge/time sensed by the sensor exceeds a predetermined value indicating a break in one of the fiber strands.

The foregoing solutions make it possible to reliably interrupt the spinning of the yarn from the remaining fiber strand as a consequence of a break in one of the two fiber strands. By utilizing the apparatus according to the present invention, it is possible to interrupt the spinning of the yarn very quickly, preferably immediately after a break in one of the two fiber strands. It is also possible to interrupt the feed of the rovings to the drawing machine to reduce fiber waste.

The sensor provided according to the present invention must sense a characteristic of the yarn which recognizably changes when the yarn is being spun from only one of the two fiber strands. This characteristic can preferably be the approximate mass per unit length of the yarn or the approximate weight per unit length of the yarn, that is the fineness or size of the yarn. The sensing of the yarn fineness can preferably be done by sensing the capacitance but can also be accomplished by an optical sensing arrangement. This is also true of the arrangement utilizing the suction device.

In the operation of the ring spinning machine according to the present invention, the interruption of the spinning of the yarn remaining after a break in one of the two fiber strands can take place in various ways. In one preferred embodiment, the interrupter is a yarn severing device which is electrically activated and disposed adjacent the path of the yarn for severing the yarn. Such a yarn severing device can preferably be a cutting device or a hot wire for burning through the yarn. It is also possible for the interrupter to be in the form of a clamping device which is electrically operated to clamp the yarn to prevent further spinning. Frequently, a relatively long period of time passes before a yarn break is corrected. Since the yarn break is frequently not corrected until after completion of a draw, the broken fiber strand from the drawing machine at the spinning location in question is no longer twisted into the yarn but is aspirated away or in some other manner collected as waste, it is often advantageous to also interrupt the continued delivery of the individual fiber strands from the drawing machine to the spinning location in question after any such fiber strand break. This can be achieved by locating an interrupter upstream of the drawing machine to stop, sever, tear, etc., the rovings fed to the first feed roller pair of the drawing machine. Such an interrupter can be formed as a clamp or a severing device.

The foregoing and other objects, features and advantages of the invention will be apparent from the following more particular description of a preferred embodiment of the invention as illustrated in the accompanying drawings.

DETAILED DESCRIPTION OF THE INVENTION

Figures 1, 2:
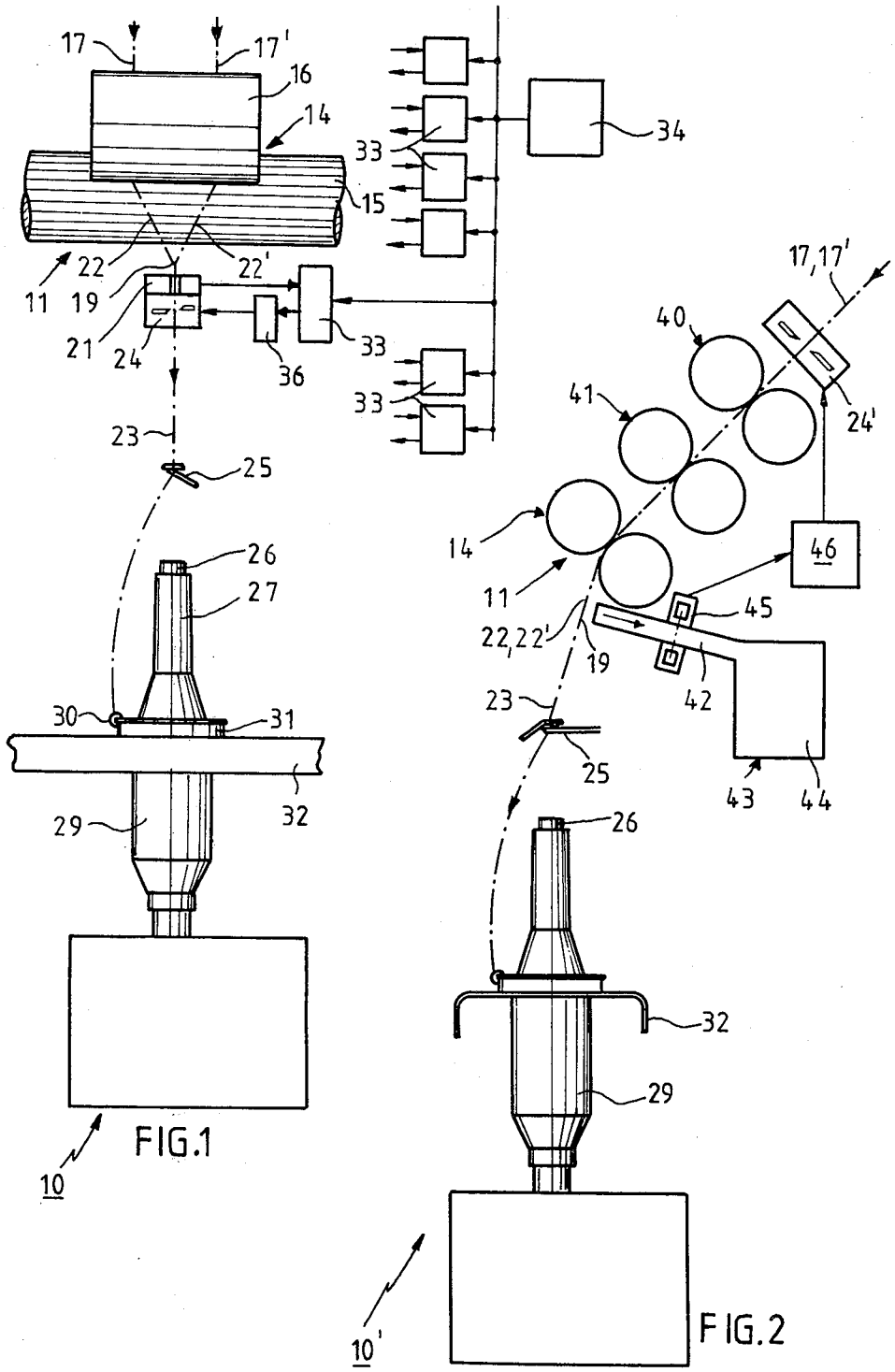
FIG. 1 is a schematic, partial front view of a spinning location in the ring spinning machine according to a first embodiment.
FIG. 2 is a schematic, side elevation view of a spinning location in a ring spinning machine according to another embodiment of the invention.

The spinning location 10 of a ring spinning machine as shown in FIG. 1 includes a drawing machine 11 having a plurality of roller pairs for drawing two spaced fiber strands 17,17' running adjacent to each other wherein only the final roll pair 14 is illustrated. The lower roll 15 of the final roll pair 14 can be formed in a manner common in most spinning machines by a cylinder which extends over almost the entire length of the side of the spinning machine. An upper roller 16 is pressed against the lower roller 15 at each spinning location. The two individual fiber strands 17,17' passing through the drawing machine are guided by fiber strand guides (not shown) which are laterally spaced from each other and after leaving the final roll pair 14, the fiber strands merge at a common joining point 19 which is located immediately above a capacitance sensor 21 which includes a yarn guide. The two individual fiber strands leaving the final roll pair 14 are still in the untwisted condition and are considered as fiber strands 22,22' up to the point 19. After the joining point, the strands are twisted together to form a yarn 23. The yarn 23 passes through the capacitance sensor 21 and immediately thereafter, passes through a severing device 24 having two blades. This severing device 24 can be electrically activated and as a result of each activation of its two blades, the yarn 23 will be severed.

As long as the severing device 24 is not activated, the yarn 23 passes through the device without being touched. The yarn then passes through a yarn guide 25 disposed at a distance above a spindle and from there passes to the rotating spindle 26 while forming a ballon. A sleeve 27 is removably located on the spindle 26 and the yarn 23 is wound onto the sleeve to form a skein 29. On the way from the yarn guide 25 to spindle 26 the yarn 23 passes through a runner 30 which travels on ring 31 which coaxially surrounds spindle 26. The ring 31 at each location is carried by member 32 which reciprocates axially of the spindle to form the skein 29.

The capacitance sensor 21 continually takes measurements which are approximately proportional to the mass per unit length of the yarn. This measurement value is fed to a threshold value detector 33, the threshold value of which can be adjusted by means of a threshold value selector 34 which is common to all spinning locations on the machine so that the threshold value of the threshold value detector 33 can be adjusted to the number of the currently spun yarn in such a manner that the signal delivered from the sensor 21 is always lower than the threshold value of the threshold value detector 33. The threshold value detector 33 thus delivers an output signal whenever the mass per unit length of the yarn 23 falls below a predetermined percentage,, such as 20–30% below the set point value. The threshold value detector 33 is thus formed in such a manner that as long as the output signal of the sensor 21 is greater than the threshold value, the threshold value detector 33 delivers no output signal. The detector 33 will deliver an output signal when the signal of the sensor 21 falls below the set threshold value. It is further provided that a value falling below the threshold value is only signaled when this low value is maintained for a predetermined, short period of time, which is choosen in such a manner that it cannot be caused by chance fluctuations of the mass per unit length of the yarn 23. The threshold value detector 33 thus detects any change in yarn size caused by the fact that one of the two fiber strands 22 or 22' is broken, since this results in the mass per unit length of the yarn being reduced by about half. The output signal of the detector 33 which always appears when one of the two fiber strands 22 or 22' is broken is transformed and amplified in an impulse forming stage 36 and is then sent to the severing device 24 to initiate the cutting process so that the yarn 23 is cut by the severing device 24 and the spinning of the yarn is thus interrupted.

In addition to the threshold value detector 33 associated with the illustrated spinning location 10, additional identical threshold value detectors 33 are schematically illustrated in FIG. 1, each of which is associated with another spinning location of the spinning machine. The fact that the threshold values of the detectors 33 can be set in common by means of the central threshold value selector 34 simplifies the adjustment of the threshold values significantly. This type of adjustment is necessary every time the yarn size of the yarn to be spun is changed.

The spinning location 10' illustrated in FIG. 2 is similar to that shown in FIG. 1. The drawing machine 11 in this embodiment has three roller pairs 40, 41 and 14 which draw the two fiber strands 17,17' therethrough in spaced parallel relation. These two fiber strands 17,17' which are not illustrated separately in FIG. 2 since it is a side view, merge at a common joining point 9 after leaving the final roller pair 14. This joining point 19 is formed between the final roller pair 14 and the yarn guide 25 which is arranged coaxially above the spindle 26. The two fiber strands 22,22' leaving the final roller pair 14 as individual fiber strands are twisted together to form the yarn 23 which is wound on the spindle 26.

A suction tube 42 of an aspiration device 43 is disposed a short distance below the final roller pair 14. The aspiration device 43 includes a main suction chamber or channel which extends along the entire length of the machine from which the various suction tubes 42 branch off at each spinning location. Each suction tube 42 has a slot-like suction opening at its free end for aspirating all of the fibers not twisted into the yarn 23.

The suction tube 42 includes a clear section through which the light beam of a photo-optical sensor is directed. As long as both fiber strands 22 and 22' are spun into the yarn 23, only very few fibers will pass individually into the suction tube 42. If, however, one of the two fiber strands 22 or 22' breaks all the fibers of this fiber strand will pass into the suction tube 42 and a relatively heavy fiber stream is then formed within the suction tube which will weaken or even completely interrupt the light beam of the photocell device 45 to such an extent that the photocell device 45 activates an electronic control device 46 electrically connected thereto. The electronic control device 46 will then deliver an electric control signal to a stop device 24, to electrically activate the device. The reaction sensitivity of the control device 46 can be adjusted. The stop device 24' is located upstream of the draw-in roller pair 40 of the drawing machine 11 at a distance therefrom and as illustrated in FIG. 2, is comprised of two cooperating blades which are normally located at a distance from each other. The two rovings which run to the drawing machine 11 at the spinning location 10' pass between the two blades and as soon as the photo-optical device activates the control device 46, the stop device 24 will be activated to cut the two rovings.

The stop device 24' can also be formed in such a manner that it does not cut the two rovings, but rather clamps them to cause a tearing of the rovings or stops them in some other manner. In any case, the cutting, clamping or the like of the two rovings interrupts the spinning of the yarn 23 remaining after the break of one of the two fiber strands after a short time since the supply of the fiber strands to the yarn is halted.

The stop device 24' as shown in FIG. 2 can also be provided in place of or in addition to the interrupter 24 illustrated in FIG. 1 at the spinning location. If it is provided in addition it does not directly interrupt the spinning of the yarn since the interrupter 24 stops the spinning of the yarn earlier than would be possible for the stop device 24'. However, the stop device 24' will eliminate the continued delivery of the broken fiber strands shortly after the stopping of the spinning, thus avoiding unnecessary fiber waste.

The interrupter 24 at the spinning location 10 according to FIG. 1 can also be provided at the spinning location 10' according to FIG. 2 in order to interrupt the spinning of the yarn very quickly after a break in one of the fiber strands. The stop device 24' can then be either eliminated or used in conjunction with the stop device 24.

It is contemplated that various other types of interrupters can be used within the scope of the present invention. The fiber strands drawn and spun on the spinning machine according to the present invention consist of conventional finite-length fibers, preferably relatively long fibers such as carded wool or the like.

While the invention has been particularly shown and described with reference to a preferred embodiments thereof, it will be understood by those in the art that the foregoing and other changes in form and details may be made therein without departing from the spirit and scope of the invention.

What is claimed is:

1. A spinning machine for spinning yarns comprised of finite length fibers comprising a plurality of drawing means each of which draws two parallel, untwisted fiber strands, guide means for converging each of said two strands to provide a plurality of yarns, spindle means for imparting a twist to said yarns and winding said yarns, sensing means located between each drawing means and each guide means for continuously sensing a characteristic of the yarn which changes in the manner recognizable to said sensing means when the yarn is only being spun from one of the two fiber strands and interrupter means responsive to said sensing means for interrupting the spinning of the yarn upon breakage of one of said strands.

2. A spinning machine for spinning yarns comprised of finite length fibers comprising a plurality of drawing means for drawing two parallel, untwisted fiber strands, a plurality of guide means for converging the two strands from each drawing means to form yarns, spindle means for imparting a twist to each yarn and winding each yarn, suction means disposed adjacent said drawing means between said guide means and said drawing means for aspirating fibers discharged from said drawing means which are not incorporated into said yarn, sensing means for sensing the volume of fibers aspirated by said suction means and interrupter means operable by said sensing means for interrupting the spinning of the yarn when the fiber discharge/drawing sensed by said sensing means exceeds a predetermined value, indicating a break of one of said fiber strands.

3. A spinning machine according to claim 1 or 2 wherein said interrupter means is comprised of an electrically operated yarn severing device arranged adjacent the path of said yarn for severing said yarn.

4. A spinning machine according to claim 3 wherein said severing device includes cutting blades.

5. A spinning machine according to claim 1 or 2 wherein said interrupter means is disposed upstream of said drawing means to prevent the feed of fibers to said drawing means.

6. A spinning machine according to claim 5 wherein said interrupter means is comprised of an electrically activated clamping means for clamping the fibers being supplied to said drawing means.

7. A spinning machine according to claims 1 or 2 wherein each of said sensing means includes a threshold value detector for supplying a signal to said interrupter means when a predetermined value of the signal delivered from said sensing means is exceeded.

8. A spinning machine as set forth in claim 7 wherein said sensing means is a capacitive sensor.

9. A spinning machine according to claim 7 wherein said sensing means is a photo-optical sensor.

* * * * *